US006612862B2

(12) United States Patent
Endo

(10) Patent No.: US 6,612,862 B2
(45) Date of Patent: Sep. 2, 2003

(54) HALF-FITTING PREVENTION CONNECTOR

(75) Inventor: Tomomi Endo, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/125,536

(22) Filed: Apr. 19, 2002

(65) Prior Publication Data

US 2002/0160652 A1 Oct. 31, 2002

(30) Foreign Application Priority Data

Apr. 20, 2001 (JP) ..... P2001-123107

(51) Int. Cl.[7] ..... H01R 3/00
(52) U.S. Cl. ..... 439/489
(58) Field of Search ..... 439/489, 352, 439/358, 357, 354

(56) References Cited

U.S. PATENT DOCUMENTS 5,163,848 A 11/1992 Maeda et al.
5,655,928 A 8/1997 Akeda
5,775,930 A * 7/1998 Model et al. ..... 439/489
6,126,480 A * 10/2000 Kawase et al. ..... 439/489
6,325,663 B1 * 12/2001 Fukuda ..... 439/489

FOREIGN PATENT DOCUMENTS

| | | |
|---|---|---|
| EP | 0 660 451 A2 | 6/1995 |
| EP | 0 993 078 A1 | 4/2000 |
| JP | 5-234637 | 9/1993 |
| JP | 8-31517 | 2/1996 |
| JP | 9-134757 | 5/1997 |
| JP | 9-148003 | 6/1997 |
| JP | 9-180818 | 7/1997 |

* cited by examiner

*Primary Examiner*—Gary Paumen
(74) *Attorney, Agent, or Firm*—Sughrue Mion, PLLC

(57) ABSTRACT

A lock arm (31) includes a leg portion (31*b*), which is provided at an intermediate portion of a lock portion (34) between at a front end portion and a rear end thereof, and extends to a housing body (35) of a male connector housing (33), and the lock arm can be pivotally moved on the leg portion (31*b*) serving as a fulcrum. A fitting detection member (51) of a lever-like shape is mounted on the male connector housing (33) such that when the fitting detection member is pressed down by a detection member-limiting portion (61), provided at the rear end of the lock arm (31), a front end portion of the fitting detection member is pivotally displaced outwardly from the housing body (35).

2 Claims, 8 Drawing Sheets

HALF-FITTING PREVENTION CONNECTOR

BACKGROUND OF THE INVENTION

1. Field of the Invention

This invention relates generally to a half-fitting prevention connector for connecting automotive wire harnesses together, and more particularly to a half-fitting prevention connector in which a mutually-fitted condition of a pair of connector housings, which are to be fitted together in a male-female manner, can be confirmed by the look of a fitting detection member provided at one of the connector housings.

The present application is based on Japanese Patent Application No. 2001-123107, which is incorporated herein by reference.

2. Related Art

FIGS. 10 to 12 show a conventional half-fitting prevention connector used for connecting automotive wire harnesses together.

This half-fitting prevention connector 1 is disclosed in JP-A-5-234637, and comprises a male connector housing 5, having a lock arm 3, a female connector housing 9, which has an engagement portion 7 for engagement with a lock portion 3*a* of the lock arm 3, and can be connected to the male connector housing 5 in a locked condition when it is fitted on the male connector housing 5 in a male-female manner, a fitting detection member 11 pivotally mounted on the female connector housing 9, and detection member-limiting portions 13 and 14 for pivotally displacing the fitting detection member 11 outwardly from the female connector housing 9 when the mutually-fitted condition of the pair of connector housings 5 and 9 is incomplete, that is, a half-fitted condition.

As shown in FIGS. 11 and 12, the fitting detection member 11 comprises a support shaft 11*a*, mounted on a rear portion of a housing body 9*a* of the female connector housing 9, a pivotal arm 11*b*, pivotally supported on this support shaft 11*a*, elastic retaining piece portions 11*c*, which are formed on and project from a distal end of the pivotal arm 11*b*, and are engageable with an arm retaining portion 9*b* of the housing body 9*a* to hold the pivotal arm 11*b* in contiguous relation to the surface of the housing body 9*a* (as shown in FIG. 11), and a fitting confirmation projection 11*d*.

When the elastic retaining piece portions 11*c* are disposed out of engagement with the arm retaining portion 9*b*, this fitting detection member 11 can be pivotally moved outwardly from the housing about the support shaft 11*a* as indicated by arrow A in FIG. 12.

At an initial stage of the fitting of the connector housings 5 and 9, a tapering portion 14*a*, formed at a front end of one detection member-limiting portion 14, pushes a distal end of the elastic retaining piece portion 11*c*, retained by the arm retaining portion 9*b*, thereby canceling the engagement between the arm retaining portion 9*b* and the elastic retaining piece portion 11*c*, so that the fitting detection member 11 can be pivotally moved outwardly form the housing.

Before the connector housings 5 and 9 are completely fitted together, the detection member-limiting portions 13 and 14 are held against a lower end of the fitting confirmation projection lid to limit the pivotal movement of the fitting detection member 11 toward the housing, and therefore the fitting detection member 11 is kept displaced outwardly from the housing, so that the fitting confirmation projection lid is exposed to the exterior of the housing body 9*a*, as shown in FIG. 12.

When the connector housings 5 and 9 are completely fitted together as shown in FIG. 11, with the lock portion 3*a* engaged with the engagement portion 7, the detection member-limiting portions 13 and 14 are disposed at their respective positions where they will not interfere with the elastic retaining piece portions 11*c* and the fitting confirmation projection lid, so that the fitting detection member 11 can be returned into its initial position where the elastic retaining piece portions 11*c* are retained by the arm retaining portion 9*b*. As a result, the completely-fitted condition of the two connector housings can be confirmed.

Namely, in the half-fitting prevention connector 1, the fitting confirmation projection 11*d* of the fitting detection member 11 projects outwardly from the housing, and the elastic retaining piece portions 11*c* can not engage the arm retaining portion 9*b*, and by doing so, the half-fitted condition of the two connector housings can be detected.

However, the length L of outward projection of the fitting detection member 11 from the housing in the half-fitted condition is determined by the height of the detection member-limiting portion 13 (on which the fitting confirmation projection 11*d* can slide) and the height of the fitting confirmation projection 11*d*. When the dimensions of these portions are reduced as a result of a compact design of the connector, the projecting length L in the half-fitted condition is also reduced, and therefore it is difficult to confirm with the eyes whether or not this projecting has occurred, and this has invited a problem that the half-fitted condition has been overlooked.

SUMMARY OF THE INVENTION

This invention has been made under the above circumstances, and an object of the invention is to provide a half-fitting prevention connector in which the overlooking of a half-fitted condition of two connector housings can be positively prevented even in the case where the dimension of a detection member-limiting portion for displacing a fitting detection member outwardly from the housing is reduced as a result of a compact design of the connector.

The above object has been achieved by a half-fitting prevention connector comprising: a first connector housing having a lock arm including a leg portion provided at an intermediate portion of the lock arm between a front end portion and a rear end thereof and extending to a housing body of the first connector, the lock arm pivotally movable on the leg portion serving as a fulcrum; a second connector housing having an engagement portion engagable with a lock portion of the lock arm, and fitted relative to the first connector housing; a fitting detection member pivotally mounted on the first connector housing in a lever-like manner; and a detection member-limiting portion provided at the rear end of the lock arm; wherein the detection member-limiting portion prevents a pivotal movement of the fitting detection member when the lock portion and the engagement portion are not in an engaged condition, and the fitting detection member is inclined when the fitting detection member is pressed down by the detection member-limiting portion before an engagement of the lock portion with the engagement portion is completed, so that a front end portion of the fitting detection member is pivotally displaced outwardly from the housing body of the first connector housing.

In the above construction, even in the case where the dimensions of the detection member-limiting portion, which can displace the fitting detection member outwardly from the housing, are reduced, the length of outward projection of the fitting detection member from the housing in the half-fitted condition is amplified to a value, larger than the displacement amount actually transmitted by the detection member-limiting portion, by the leverage of the lock arm and fitting detection member, and therefore this projection length can be increased to a value large enough to enable an easy conformation of whether or not this projecting has occurred.

In the above half-fitting prevention connector, preferably, an elastically-deformable rib is provided at a rear end of the fitting detection member, and the elastically-deformable rib is pressed down by the detection member-limiting portion of the lock arm upon inclination of the lock arm, so as to produce a bending moment to increase a displacement of the front end portion of said fitting detection member.

In this construction, the amount of outward pivotal displacement of the front end portion of the fitting detection member from the housing is the sum of the amplified displacement amount, obtained by the leverage of the lock arm and fitting detection member, and the pivotal displacement amount obtained by the bending moment produced by the elastically-deformable rib. Thus, the amount of displacement of the fitting detection member in the half-fitted condition is further increased.

DETAILED DESCRIPTION OF THE PREFERRED EMBODIMENTS

A preferred embodiment of a half-fitting prevention connector of the present invention will now be described in detail with reference to the drawings.

Figure 1:
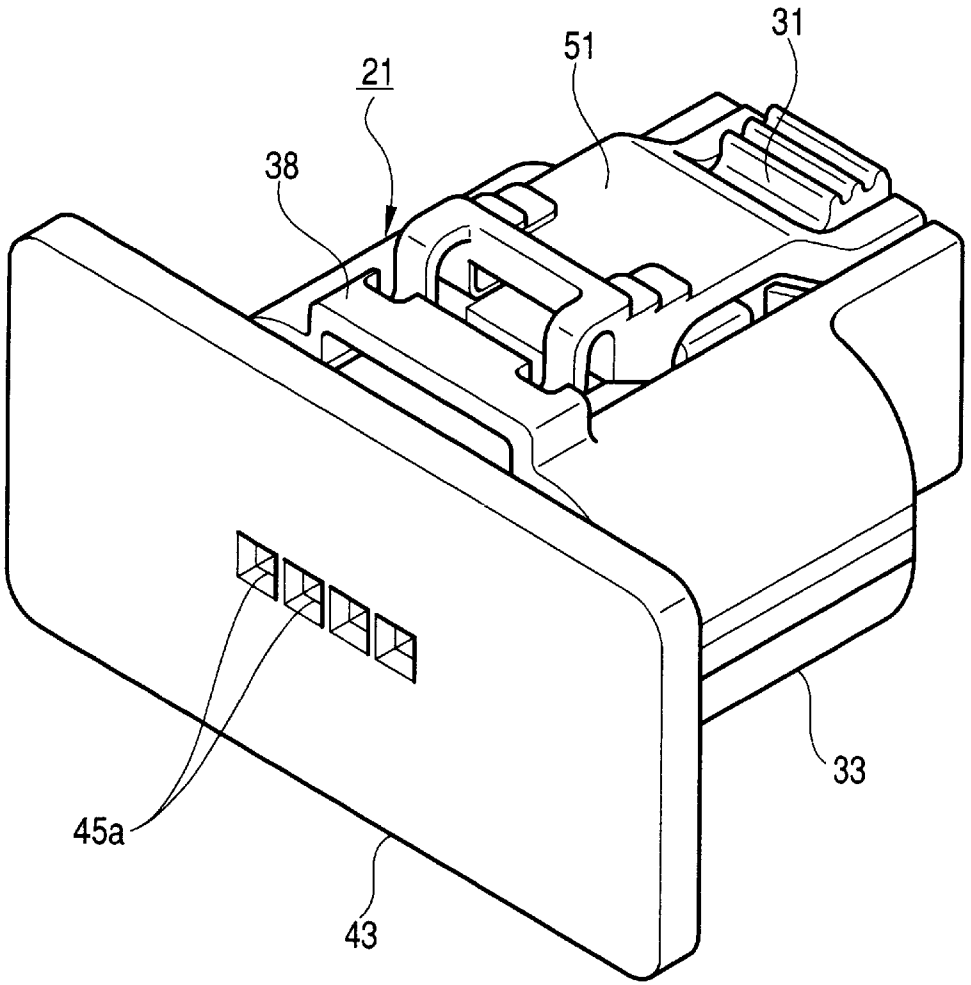
FIG. 1 is a perspective view showing the appearance of one preferred embodiment of a half-fitting prevention connector of the invention in a completely-fitted condition.
Figure 2:
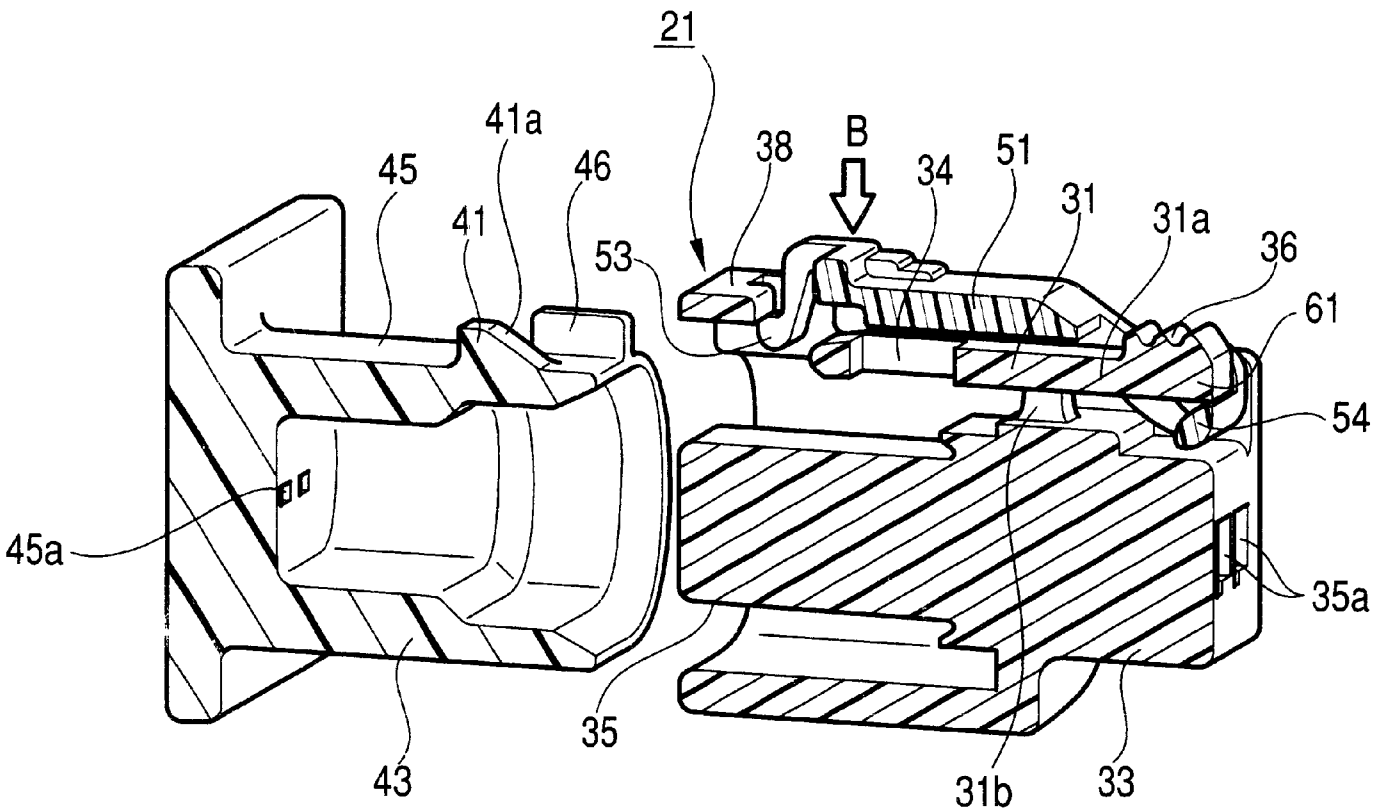
FIG. 2 is a cross-sectional, perspective view showing a condition before two connector housings of FIG. 1 are fitted together.
Figure 3:
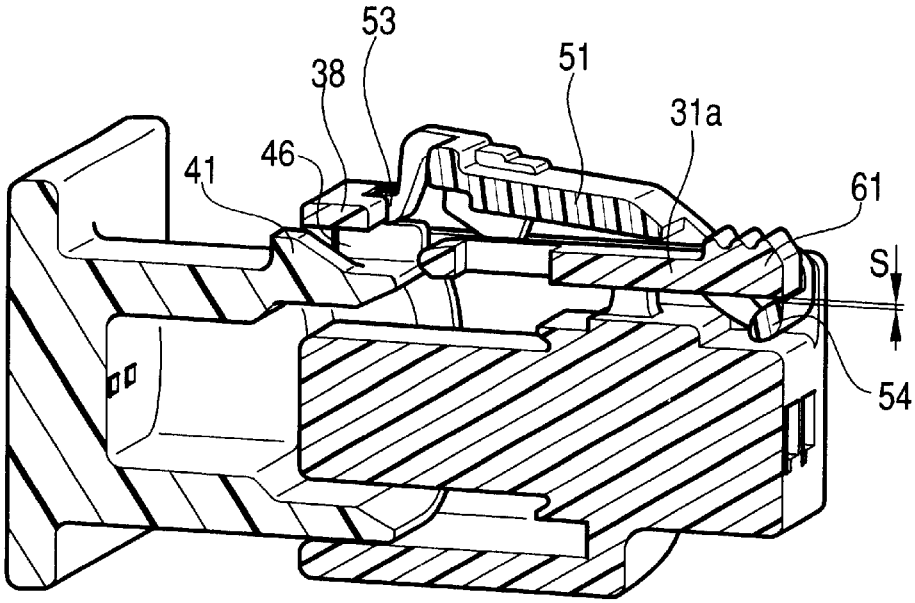
FIG. 3 is a cross-sectional, perspective view showing a condition in which the two connector housings are in the process of being fitted together.
Figure 4:
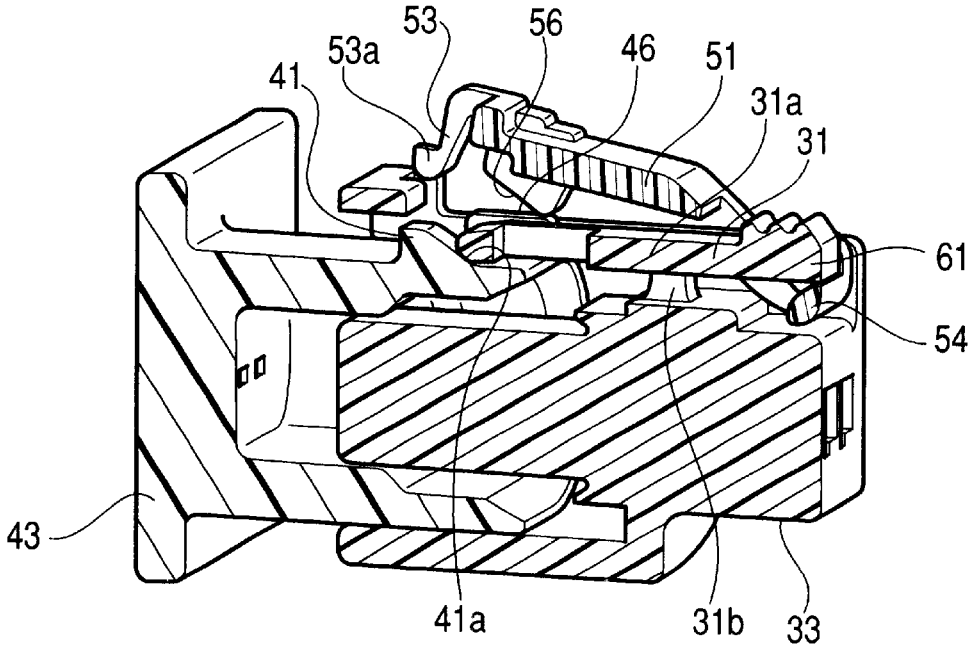
FIG. 4 is a cross-sectional, perspective view showing a condition in which a lock portion of a lock arm begins to slide onto an engagement portion of a mating connector when the two connector housings are in the process of being fitted together.
Figure 5:
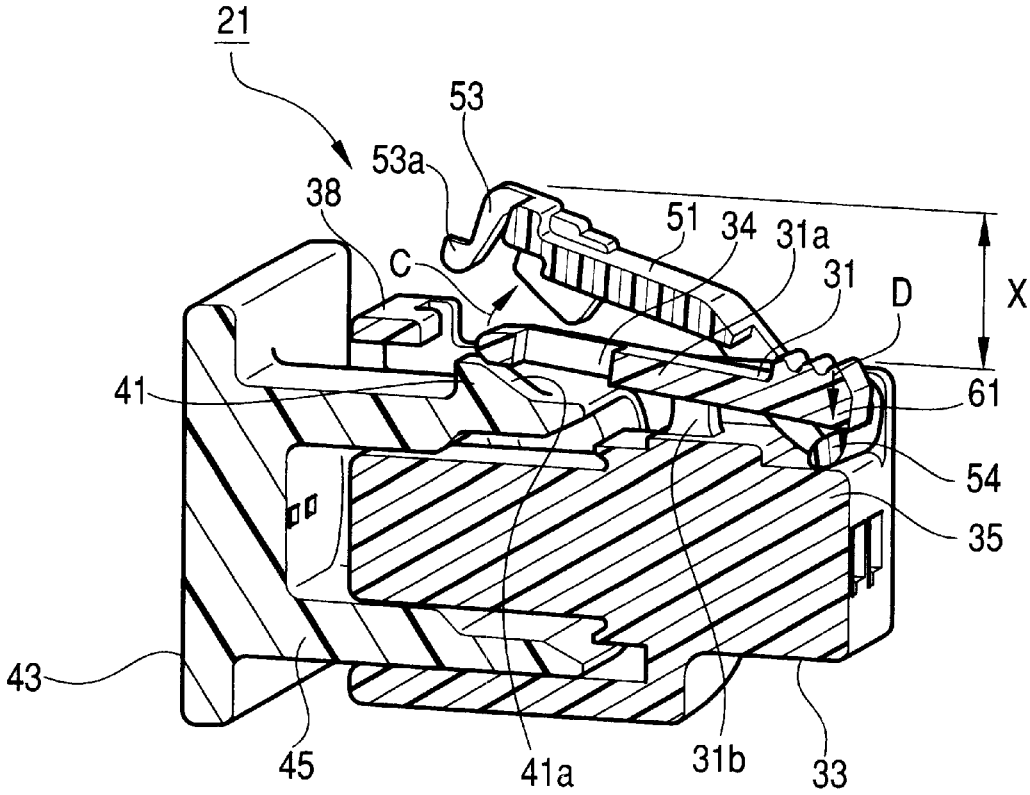
FIG. 5 is a cross-sectional, perspective view showing a half-fitted condition in which the lock portion of the lock arm slides on the engagement portion of the mating housing when the two connector housings are in the process of being fitted together.
Figure 6:
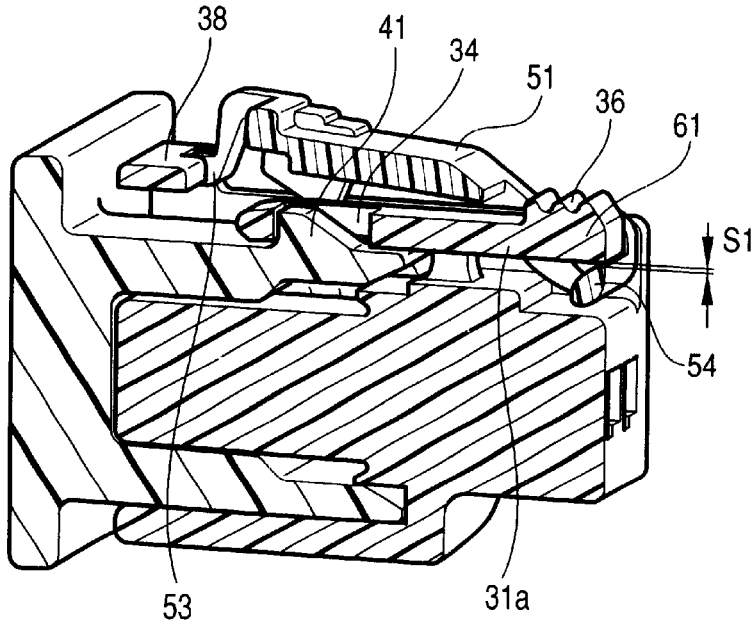
FIG. 6 is a cross-sectional, perspective view showing a condition immediately before a fitting detection member is returned to an initial position after the fitting of the two connector housings relative to each other is properly completed.
Figure 7:
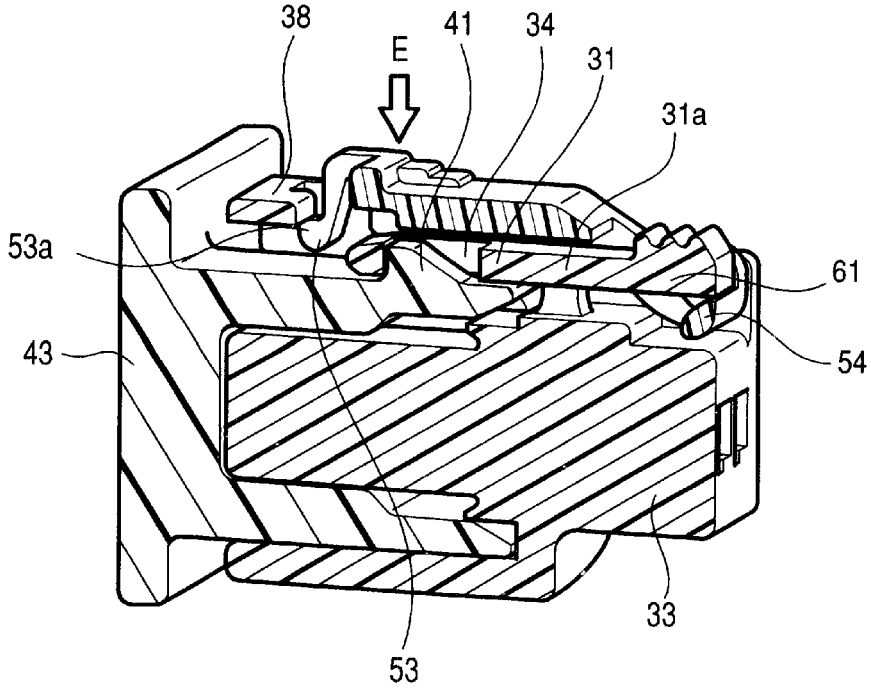
FIG. 7 is a cross-sectional, perspective view showing the completely-fitted condition of the two connector housings, in which the fitting detection member is returned to the initial position after the fitting of the two connector housings is properly completed.
Figure 8:
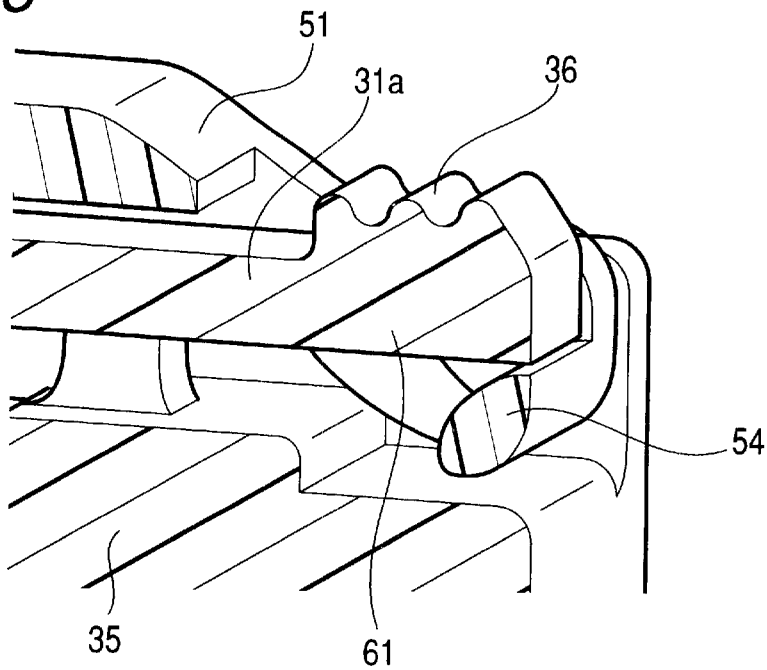
FIG. 8 is an enlarged view of important portions of the two connector housings of FIG. 4 which are in the process of being fitted together.
Figure 9:
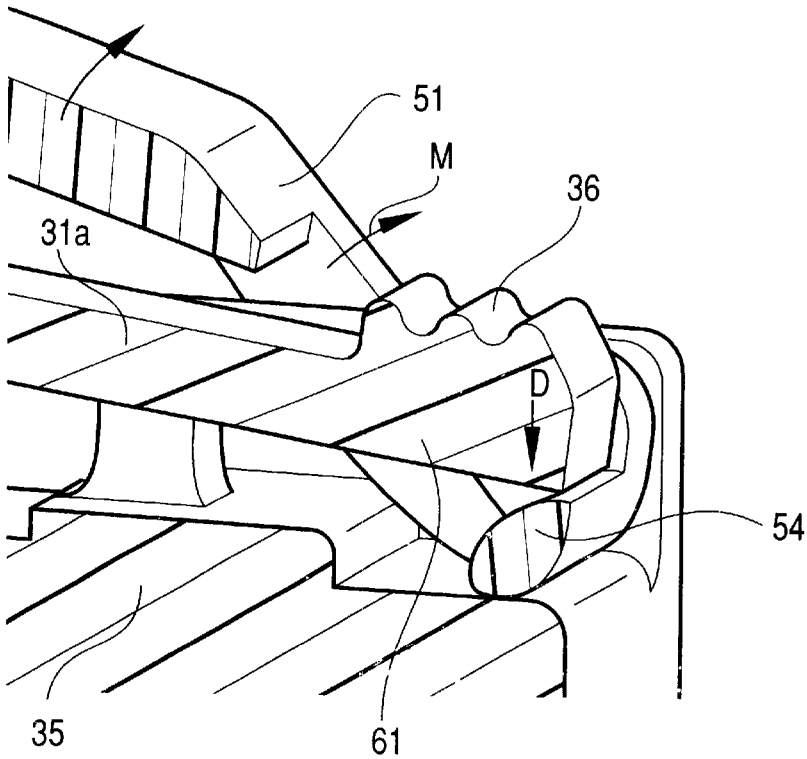
FIG. 9 is an enlarged view of important portions of the two connector housings of FIG. 5 which are in the process of being fitted together.
Figure 10:
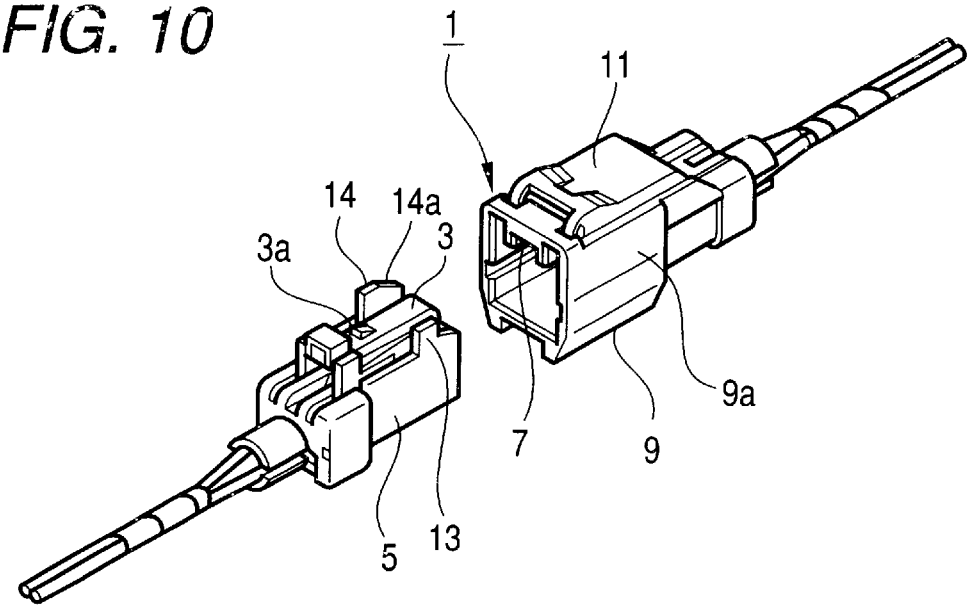
FIG. 10 is an exploded, perspective view of a conventional half-fitting prevention connector, showing a condition before a fitting operation is effected.
Figure 11:
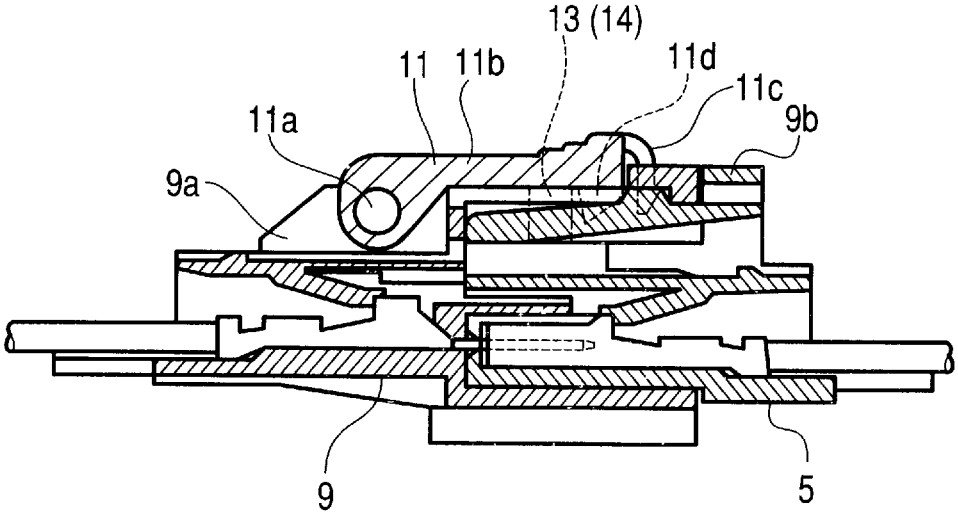
FIG. 11 is a vertical cross-sectional view of the half-fitting prevention connector of FIG. 10 in a completely-fitted condition.
Figure 12:
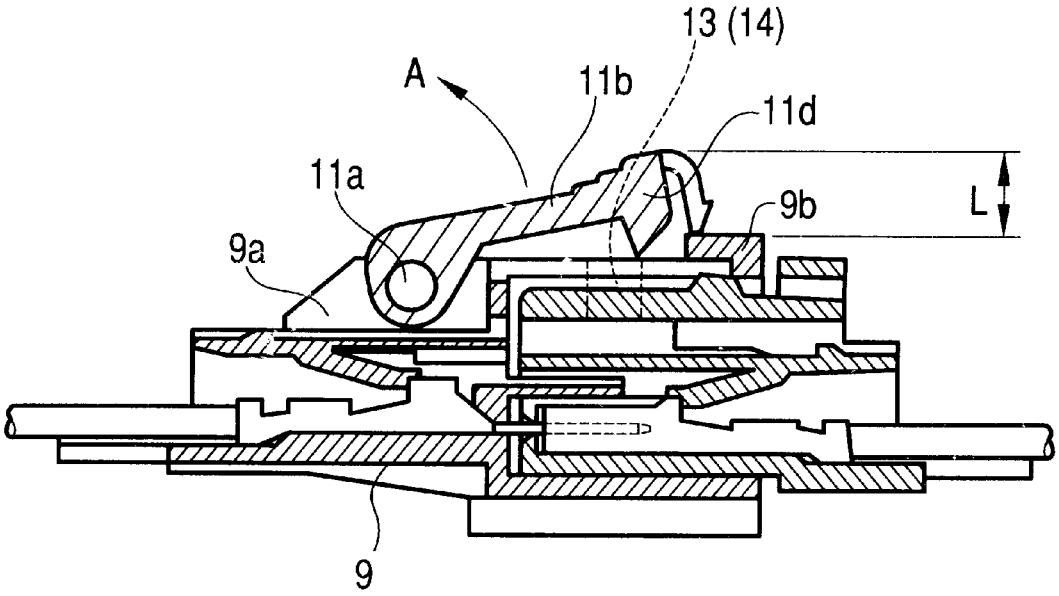
FIG. 12 is a vertical cross-sectional view of the half-fitting prevention connector of FIG. 10 in a half-fitted condition.

FIGS. 1 to 9 show one preferred embodiment of the half-fitting prevention connector of the invention, and FIG. 1 is a perspective view showing the appearance of the half-fitting prevention connector of the invention in a completely-fitted condition; FIG. 2 is a cross-sectional, perspective view showing a condition before two connector housings are fitted together; FIG. 3 is a cross-sectional, perspective view showing a condition in which the two connector housings are in the process of being fitted together; FIG. 4 is a cross-sectional, perspective view showing a condition in which the two connector housings are in the process of being fitted together; FIG. 5 is a cross-sectional, perspective view showing a half-fitted condition in which a lock portion of a lock arm slides on an engagement portion of the mating housing when the two connector housings are in the process of being fitted together; FIG. 6 is a cross-sectional, perspective view showing a condition immediately before a fitting detection member is returned to an initial position after the fitting of the two connector housings relative to each other is properly completed; FIG. 7 is a cross-sectional, perspective view showing the two connector housings in a completely-fitted condition; FIG. 8 is an enlarged view of important portions of the two connector housings of FIG. 4 which are in the process of being fitted together; and FIG. 9 is an enlarged view of important portions of the two connector housings of FIG. 5 which are in the process of being fitted together.

This half-fitting prevention connector 21 comprises the male connector housing (first connector housing) 33, having the lock arm 31, the female connector housing (second connector housing) 43, which has an engagement portion 41 for engagement in the lock portion 34 of the lock arm 31, and can be fitted on the male connector housing 33 in a male-female manner, the fitting detection member 51 pivotally mounted on the male connector housing 33, and a detection member-limiting portion 61 for preventing the pivotal movement of the fitting detection member 51 in a connector-half-fitted condition in which the length of fitting of the connector housings 33 and 43 relative to each other does not reach a predetermined value, so that the lock portion 34 is disposed out of engagement with the engagement portion 41. In this construction, whether or not the fitted condition of the connector housings 33 and 43 is good is judged by the outward projection of the fitting detection member 51 from the housing.

The male connector housing 33 includes a housing body 35 having terminal receiving chambers 35*a* for respectively receiving and holding female terminals (not shown), and this housing body 35 can be inserted into a housing body 45 of the female connector housing 43 as shown in FIGS. 3 to 7.

The lock arm 31 includes an arm portion 31*a*, which is formed on an upper surface of the housing body 35 in a projected manner, and has the lock portion 34 formed at a front end thereof, and also has a lock cancellation-operating pressing portion 36 formed on an upper surface of a rear end portion thereof, and leg portions 31*b* connecting an intermediate portion of the arm portion 31*a* to the upper surface of the housing body 35. The arm portion 31*a* can be turned on the leg portions 31*b* (each serving as a fulcrum) so that front and rear ends of this arm portion 31*a* can be pivotally displaced upward and downward.

The front end portion of the arm portion 31*a* is formed into a wedge-shaped cross-section, and has upper and lower tapering surfaces. The lock portion 34 is defined by a retaining hole which is formed in an upward-downward direction through that portion of the arm portion 31*a* disposed immediately adjacent to the cross-sectionally wedge-shaped front end portion thereof.

In this embodiment, the lower surface of the rear end portion of the arm portion 31*a* serves as the detection member-limiting portion 61 for displacing the fitting detection member 51.

The female connector housing 43 includes a housing body 45, having terminal receiving chambers 45*a* for respectively receiving and holding male terminals (not shown), the engagement portion 41, formed on and projecting from an upper surface of this housing body 45, and detection member cancellation projections 46 formed on the upper surface of the housing body 45.

The engagement portion 41 is in the form of a projection having a tapering surface 41*a* formed at its distal end, and when the connector housings 33 and 43 are fitted together, this engagement portion 41 slides under the front end portion of the arm portion 31*a* as shown in FIGS. 4 and 5, and advances between the housing body 35 of the male connector housing 33 and the arm portion 31*a* while elastically deforming the front end of the arm portion 31*a* upwardly through its tapering surface 41*a*, and when the length of fitting of the two housings relative to each other reaches the predetermined value, that is, when the completely-fitted condition is achieved, the engagement portion 41 is fitted into the elastically-restored lock portion 34 from the lower side, and thus this engagement portion is engaged in the lock portion 34.

Namely, when the front end portion of the arm portion 31*a* slides onto the tapering surface 41*a* and apex of the engagement portion 41, and is lifted, the lock arm 31 is turned on the leg portions 31*b* (serving as a fulcrum) to be inclined in such a manner that the front end of the arm portion 31*a* is pivotally moved outwardly from the housing while the rear end of this arm portion 31*a* is pivotally moved toward the housing. When the engagement portion 41 is engaged in the lock portion 34, so that the lifting of the arm portion 31*a* by the engagement portion 41 is canceled, the inclined condition of the arm portion 31*a* is canceled by its own elastic restoring force.

The fitting detection member 51 is a lever-like member, and when the lock arm 31 is pivotally moved by the engagement portion 41, this fitting detection member 51 is pressed down by the detection member-limiting portion 61, formed at the rear end portion of the lock arm 31, so that the front end portion of this fitting detection member 51 is pivotally displaced outwardly from the connector housing.

Elastic retaining piece portions 53, which can be retained by a provisionally-retaining portion 38 formed at the male connector housing 33, are formed at a front end of the fitting detection member 51, and an elastically-deformable rib 54, which can be pressed down by the detection member-limiting portion 61, defined by the lower surface of the rear end portion of the arm portion 31*a*, is formed at a rear end of the fitting detection member 51. The fitting detection member 51 is pivotally mounted on the male connector housing 33 by a pivot shaft (not shown) which is provided at the fitting detection member 51, and is engaged in pivot holes (not shown) formed in the male connector housing 33, the axis of pivotal movement of the fitting detection member 51 being slightly spaced from the elastically-deformable rib 54 toward the front end.

When the front end of the fitting detection member 51 is pressed down to its initial position as indicated by arrow B in FIG. 2, the provisionally-retaining portion 38 retains hook portions 53*a*, formed respectively at distal ends of the elastic retaining piece portions 53, and this provisionally-retaining portion 38 thus retains the fitting detection member 51 against accidental pivotal movement during the transport of the connector.

The detection member cancellation projections 46, formed on and projecting from the female connector housing 43, press the hook portions 53*a* of the elastic retaining piece portions 53 rearwardly when these cancellation projections 46 pass beneath the provisionally-retaining portion 38 at the initial stage of the fitting of the connector housings 33 and 43, and at this time, the elastic retaining piece portions 53 are elastically deformed, so that the engagement of the hook portions 53*a* with the provisionally-retaining portion 38 is canceled, thereby enabling the pivotal movement of the fitting detection member 51, as shown in FIG. 3.

Before the front end of the arm portion 31*a* slides onto the tapering surface 41*a* of the engagement portion 41 during the fitting operation, the detection member cancellation projections 46 respectively support auxiliary projections 56, projecting downwardly from an intermediate portion of the fitting detection member 51, from the lower side as shown in FIG. 4, thereby keeping the front end of the fitting detection member 51 projected outwardly more than a predetermined amount from the connector housing 33.

At the initial stage of the engagement of the two housings with each other at which the engagement of the elastic retaining piece portions 53 with the provisionally-retaining portion 38 is canceled by the detection member cancellation projections 46, a slight gap S is formed between the elastically-deformable rib 54 of the fitting detection member 51 and the detection member-limiting portion 61 provided at the rear end of the arm portion 31*a* as shown in FIG. 3.

Then, as shown in FIG. 4, the fitting of the two housings proceeds, and the detection member cancellation projections 46 abut against the lower surfaces of the auxiliary projections 56, respectively, and immediately before the front end of the arm portion 31*a* slides onto the tapering surface 41*a*, the above-mentioned gap S is eliminated, and the elastically-deformable rib 54 at the rear end of the fitting detection member 51 is held between the housing body 35 and the detection member-limiting portion 61 in a gripped manner as shown in FIG. 8.

Then, the fitting of the two housings further proceeds, and when the front end of the arm portion 31*a* slides onto the tapering surface 41*a*, so that the arm portion 31*a* is inclined, with its front end raised as indicated by arrow C in FIG. 5, the elastically-deformable rib 54 is pressed down in a direction of arrow D by the detection member-limiting portion 61, formed at the rear end of this arm portion 31*a*, and by the leverage, obtained at this time, the front end portion of the fitting detection member 51 is much pivotally moved outwardly from the housing as shown in FIG. 5.

In this embodiment, when the detection member-limiting portion 61 depresses the elastically-deformable rib 54 to pivotally move the fitting detection member 51, the elastically-deformable rib 54 is elastically deformed as shown in FIG. 9, and the shape and dimensions of the elastically-deformable rib 54 are so determined that the elastically-deformable rib 54, thus elastically deformed, can produce a bending moment M to increase the amount of displacement of the front end portion of the fitting detection member 51.

Then, the fitting of the two housings further proceeds, and when the front end of the arm portion 31*a* passes past the engagement portion 41 as shown in FIG. 6, the engagement portion 41 is engaged in the lock portion 34 provided at the arm portion 31*a*. When the inclination of the arm portion 31*a*, slanting upwardly forwardly, is canceled as a result of engagement of the engagement portion 41 in the lock portion 34, the detection member-limiting portion 61 is returned to its initial position, and the depression of the elastically-deformable rib 54 by the detection member-limiting portion 61 is canceled. As a result, the fitting detection member 51 is returned to the same inclined condition as obtained when the engagement of the elastic retaining piece portions 53 with the provisionally-retaining portion 38 is canceled by the detection member cancellation projections 46, and a slight gap S1 is formed between the detection member-limiting portion 61 and the elastically-deformable rib 54.

In this condition, the front end portion of the fitting detection member 51 is pressed down as indicated by arrow E in FIG. 7 to bring the hook portions 53*a* of the elastic retaining piece portions 53 into engagement with the provisionally-retaining portion 38, thus completing the operation for fitting the connector housings 33 and 43 together.

If the connector housings 33 and 43 are disposed in a half-fitted condition, the front end portion of the fitting detection member 51 much projects outwardly from the housing as shown in FIG. 5, and the pivotal movement of the fitting detection member 51 is prevented, with the elastically-deformable rib 54 grippingly held between the detection member-limiting portion 61 and the housing body 35, and therefore even when the front end portion of the fitting detection member 51 is pressed, the fitting detection member 51 can not be returned to its initial position.

In the half-fitting prevention connector 21 of this embodiment, even in the case where the dimensions of the detection member-limiting portion 61 are reduced as a result of a compact design of the connector, the length X of outward projection of the fitting detection member 51 from the housing in the half-fitted condition is amplified to a value, larger than the displacement amount actually transmitted from the detection member-limiting portion 61, by the leverage of the lock arm 31 and fitting detection member 51, and therefore this projection length can be set to a value large enough to enable an easy conformation of whether or not this projecting has occurred.

Therefore, when the half-fitted condition is encountered, a large amount of pivotal movement of the fitting detection member 51 occurs, and therefore merely by confirming with the eyes whether or not the fitting detection member 51 is projected, the half-fitted condition can be positively detected, and the overlooking of the half-fitted condition can be positively prevented.

In this embodiment, when the elastically-deformable rib 54, provided at the end of the fitting detection member 51, is depressed by the detection member-limiting portion 61, this rib 54 is elastically deformed to produce a bending moment to increase the amount of pivotal movement of the front end portion of the fitting detection member 51. Therefore, the amount of outward pivotal displacement of the fitting detection member 51 from the housing is the sum of the amplified displacement amount, obtained by the leverage of the lock arm 31 and fitting detection member 51, and the pivotal displacement amount obtained by the bending moment produced by the elastically-deformable rib 54. Thus, the amount of displacement of the fitting detection member 51 in the half-fitted condition is further increased, and it is easier to confirm with the eyes whether or not the fitting detection member 51 is projected.

The structure of the elastically-deformable rib is not limited to that of this embodiment. The shape and dimensions of the elastically-deformable rib can be suitably changed in so far as a large bending moment can be produced when the rib is depressed by the detection member-limiting portion, and is elastically deformed.

In the half-fitting prevention connector of the present invention, the length of outward projection of the fitting detection member from the housing in the half-fitted condition is amplified to a value, larger than the displacement amount actually transmitted from the detection member-limiting portion, by the leverage of the pivotally-moving lock arm and fitting detection member, and therefore this projection length can be set to a value large enough to enable an easy confirmation of whether or not this projecting has occurred.

Therefore, if the two connector housings are in the half-fitted condition, a large amount of pivotal movement of the fitting detection member occurs, and therefore merely by confirming with the eyes whether or not the fitting detection member is projected, the half-fitted condition can be positively detected, and the overlooking of the half-fitted condition can be positively prevented.

In the construction of claim 2, the amount of outward pivotal displacement of the front end portion of the fitting detection member from the housing is the sum of the amplified displacement amount, obtained by the leverage of the lock arm and fitting detection member, and the pivotal displacement amount obtained by the bending moment produced by the elastically-deformable rib. Thus, the amount of displacement of the fitting detection member in the half-fitted condition is further increased, and it is easier to confirm with the eyes whether or not the fitting detection member is projected.

What is claimed is:

1. A half-fitting prevention connector comprising:

a first connector housing having a lock arm including a leg portion provided at an intermediate portion of said lock arm between a front end portion and a rear end thereof and extending to a housing body of said first connector, said lock arm pivotally movable on said leg portion serving as a fulcrum;

a second connector housing having an engagement portion engagable with a lock portion of said lock arm, and fitted relative to said first connector housing;

a fitting detection member pivotally mounted on said first connector housing in a lever-like manner; and a detection member-limiting portion provided at said rear end of said lock arm;

wherein said detection member-limiting portion prevents a pivotal movement of said fitting detection member when said lock portion and said engagement portion are not in an engaged condition, and said fitting detection member is inclined when a rear end of said fitting detection member is pressed down by said detection member-limiting portion before an engagement of said lock portion with said engagement portion is completed, so that a front end portion of said fitting detection member is pivotally displaced outwardly from said housing body of said first connector housing.

2. A half-fitting prevention connector according to claim 1, wherein an elastically-deformable rib is provided at a rear end of said fitting detection member, and said elastically-deformable rib is pressed down by said detection member-limiting portion of said lock arm upon inclination of said lock arm, so as to produce a bending moment to increase a displacement of said front end portion of said fitting detection member.

* * * * *